US009642456B2

(12) United States Patent
Cooper et al.

(10) Patent No.: US 9,642,456 B2
(45) Date of Patent: May 9, 2017

(54) MODULAR SHELVING

(71) Applicants: Shawn P. Cooper, Chesterland, OH (US); Elijah H. Arons, Chelsea, MI (US); Sanford O. Mouch, Saline, MI (US); Douglas W. Watts, Anchorage, AK (US); David D. Dohrenwend, Owensboro, KY (US)

(72) Inventors: Shawn P. Cooper, Chesterland, OH (US); Elijah H. Arons, Chelsea, MI (US); Sanford O. Mouch, Saline, MI (US); Douglas W. Watts, Anchorage, AK (US); David D. Dohrenwend, Owensboro, KY (US)

( * ) Notice: Subject to any disclaimer, the term of this patent is extended or adjusted under 35 U.S.C. 154(b) by 28 days.

(21) Appl. No.: 14/614,206

(22) Filed: Feb. 4, 2015

(65) Prior Publication Data

US 2016/0220019 A1 Aug. 4, 2016

(51) Int. Cl.

| | |
|---|---|
| ***A47B 57/34*** | (2006.01) |
| ***A47B 45/00*** | (2006.01) |
| ***A47F 5/10*** | (2006.01) |
| ***A47B 57/10*** | (2006.01) |

(52) U.S. Cl.

CPC ..... *A47B 57/34* (2013.01); *A47B 45/00* (2013.01); *A47B 57/10* (2013.01); *A47F 5/103* (2013.01)

(58) Field of Classification Search

CPC ..... A47B 57/08; A47B 57/10; A47B 57/32; A47B 57/34; A47B 96/14; A47B 96/1425; A47B 96/06; A47B 96/027; A47B 45/00; A47F 5/103

USPC ..... 211/187, 186, 189

See application file for complete search history.

(56) References Cited

U.S. PATENT DOCUMENTS

| | | | | | |
|---|---|---|---|---|---|
| 2,991,040 | A * | 7/1961 | Levy | A47F 5/08 | 108/108 |
| 3,080,980 | A * | 3/1963 | Gibbons | A47B 57/30 | 108/152 |
| 3,221,678 | A * | 12/1965 | Doherty | A47B 57/26 | 108/106 |
| 3,323,851 | A * | 6/1967 | Duboff | A47B 96/1425 | 211/107 |
| 3,347,187 | A * | 10/1967 | Khoury | A47B 57/10 | 108/108 |
| 3,612,287 | A * | 10/1971 | Maltese | A47F 5/04 | 211/182 |
| 3,642,278 | A * | 2/1972 | Hinckley | A63B 1/005 | 482/38 |
| 3,743,105 | A * | 7/1973 | David | A47F 5/13 | 211/153 |

(Continued)

*Primary Examiner* — Patrick Hawn

(74) *Attorney, Agent, or Firm* — Snell & Wilmer LLP

(57) ABSTRACT

A modular shelving system includes height-adjustable second vertical members that receive horizontal supports. Each second vertical member is supported by a first vertical member. Each combined first vertical member and second vertical member can be fastened together at different locations so the second vertical member can be positioned at different heights. The modular shelving may have a base to receive and stabilize the first vertical members. At the top of each second vertical member there may be an adjustment mechanism. The adjustment mechanism may be adjusted upward to be pressure fit against an upper stationary object such as a ceiling to help stabilize the modular shelving.

13 Claims, 9 Drawing Sheets

(56) References Cited

U.S. PATENT DOCUMENTS

| | | | | | |
|---|---|---|---|---|---|
| 3,771,466 | A * | 11/1973 | Ferdinand | A47B 96/1425 | 108/109 |
| 3,921,539 | A * | 11/1975 | Berger | A47F 5/12 | 108/106 |
| 4,233,912 | A * | 11/1980 | Ferdinand | A47B 57/10 | 108/109 |
| 4,541,344 | A * | 9/1985 | Nichols | A47B 47/022 | 108/108 |
| 5,074,422 | A * | 12/1991 | Holtz | A47B 57/10 | 108/108 |
| 5,129,525 | A * | 7/1992 | Maynard, Jr. | A47B 57/10 | 211/133.1 |
| 6,062,401 | A * | 5/2000 | Hall | A47B 87/0246 | 108/144.11 |
| 6,138,583 | A * | 10/2000 | Mahone | A47B 47/00 | 108/108 |
| 6,352,161 | B1 * | 3/2002 | Huang | A47B 81/068 | 211/40 |
| 6,409,640 | B2 * | 6/2002 | Cournoyer | 482/141 | |
| 6,443,319 | B1 * | 9/2002 | Sander | A47B 57/26 | 108/106 |
| 8,079,313 | B2 * | 12/2011 | Sparkowski | A47F 5/0018 | 108/110 |
| 2012/0298605 | A1 * | 11/2012 | Dovner | B62H 3/12 | 211/85.3 |

* cited by examiner

MODULAR SHELVING

FIELD OF THE INVENTION

The following disclosure relates to modular shelving, particularly shelving with adjustable vertical supports including horizontal shelves that can be assembled in multiple configurations.

SUMMARY OF THE INVENTION

Aspects of the present invention are directed to modular shelving that is adjustable and that can be assembled in a variety of shapes and configurations to enable it to fit in a variety of spaces and serve different purposes.

The shelving includes one or more first vertical members and one or more second vertical members. Each second vertical member is affixed to a respective first vertical member by any suitable fastening method. For example, each second vertical member may have a plurality of second openings and each respective first vertical member may have a plurality of first openings. When one or more second openings align with one or more first openings, a fastener, such as a screw, bolt or pin, may be placed through one or more of the aligned first opening(s) and second opening(s) to fix the position and height of the combined first vertical member and second vertical member. Alternatively, each second member may have retractable, spring loaded pins that can be pressed into the second vertical member. When the second vertical member is moved to a position wherein the pin aligned with one of the first openings, the spring biases the pin outward through the first opening to hold the second vertical member and first vertical member in a fixed position. The pin could be pressed inward again to move the second vertical member relative the first vertical member.

In one preferred embodiment each first vertical member includes two spaced-apart vertical sections that define a space in between for receiving a lower portion of the corresponding second vertical member.

Modular shelving according to aspects of the invention also includes shelving slots formed in each second vertical member above the second plurality of openings. The slots are for receiving a horizontal support piece such as shelf or a rod.

The modular shelving also preferably includes a base that rests on a support object, such as a floor, counter, or piece of furniture. The bottom end of each first vertical member is preferably received in the and/or fastened to base to provide stability for each first vertical member. Modular shelving according to aspects of the invention may also include a top portion that fits onto one or more of the tops of each second vertical member. The top portion preferably includes a cap that fits over the top of a second vertical member and an adjustable end piece that can be extended from the cap, such as by threading it to extend it or extending it in any other suitable manner, until it presses against a stationary object above the second vertical member, such as a ceiling or stationary shelving to help stabilize the modular shelving.

DETAILED DESCRIPTION OF PREFERRED EMBODIMENTS

Figure 1:
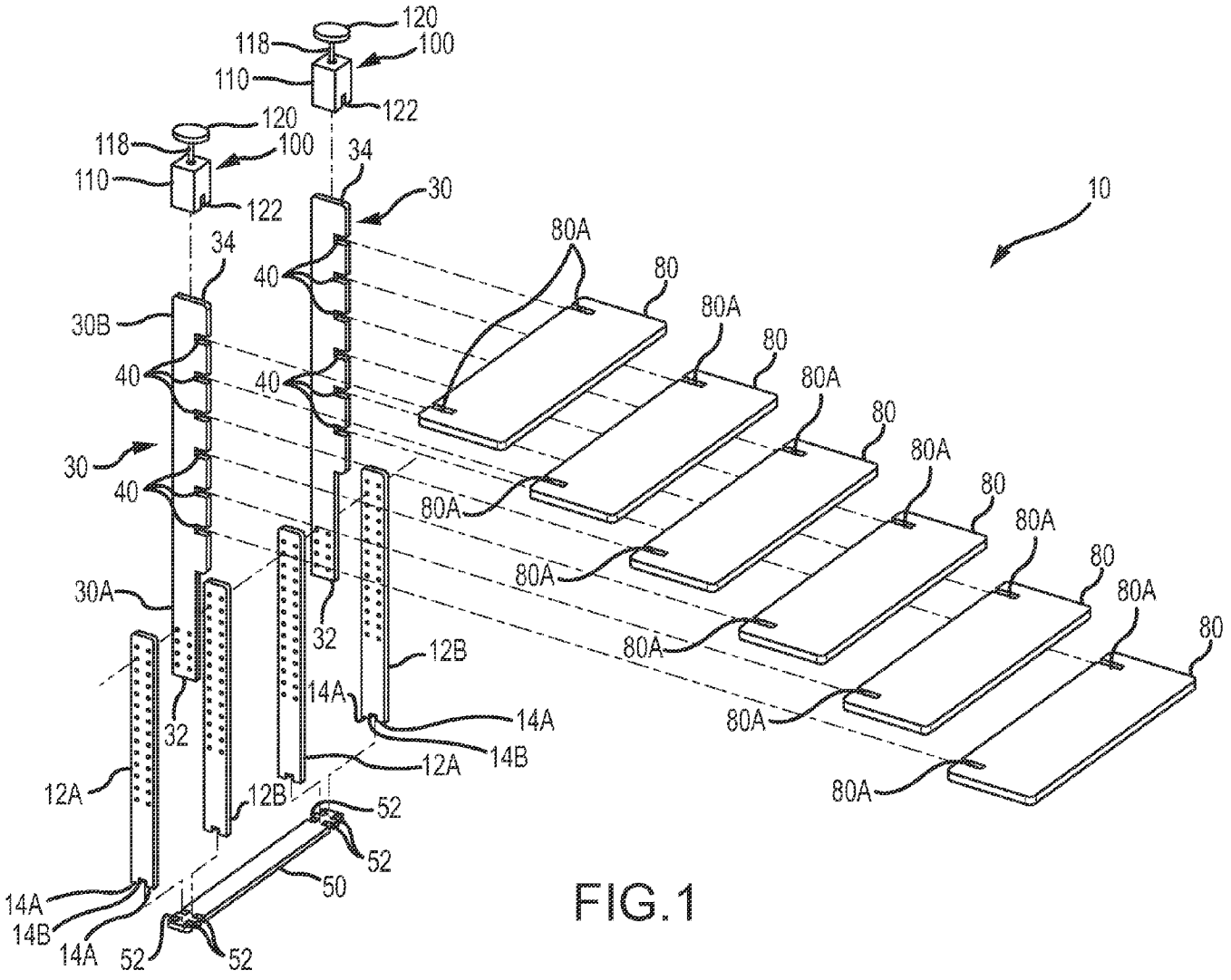
FIG. 1 is an exploded view of an embodiment according to aspects of the invention.
Figure 2:
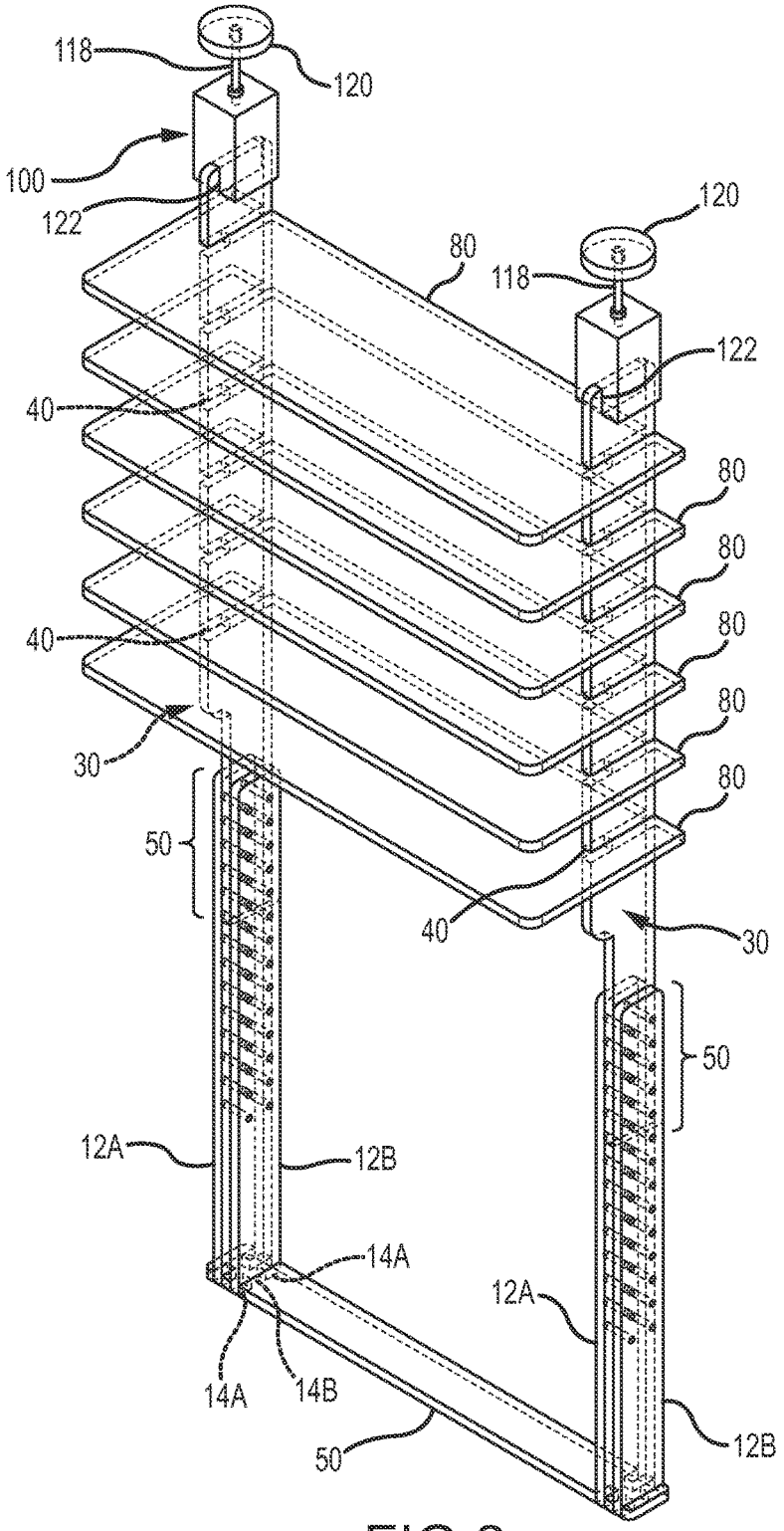
FIG. 2 is a front, perspective, cross-sectional view of an embodiment according to aspects of the invention.
Figure 3:
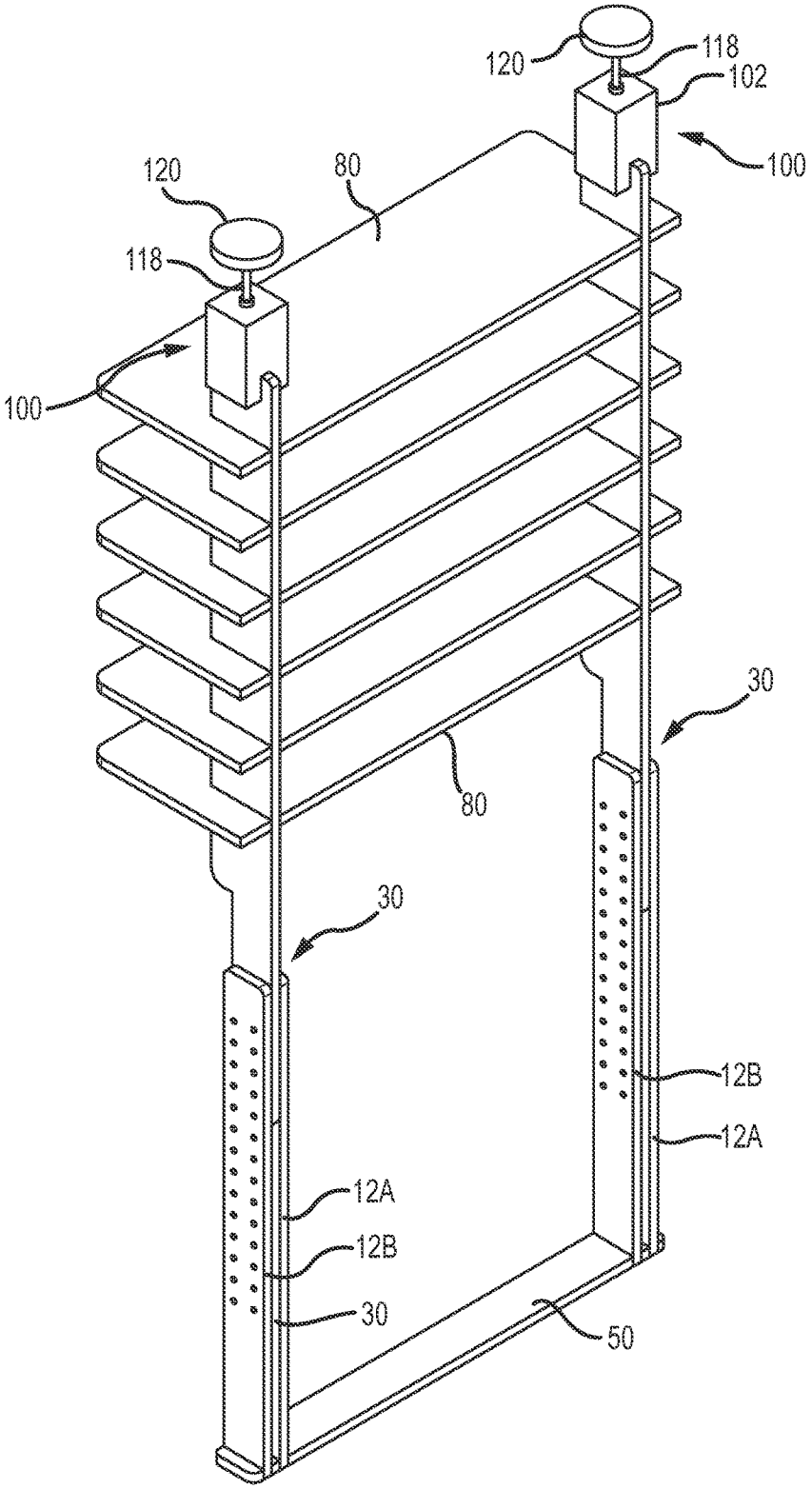
FIG. 3 is a rear, perspective view of the embodiment of FIG. 2.
Figure 4:
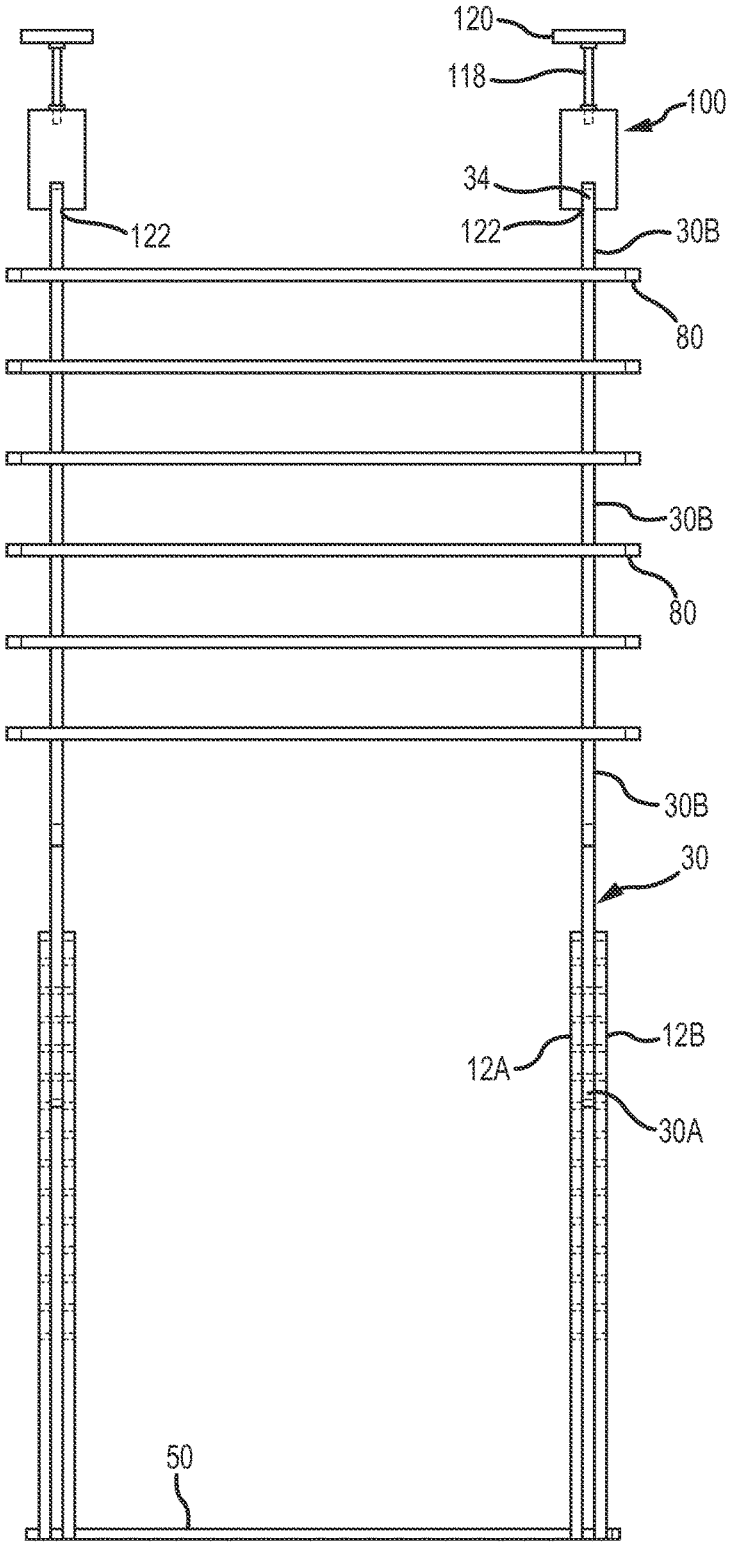
FIG. 4 is a front, partial cross-sectional view of the embodiment of FIG. 2.
Figure 5:
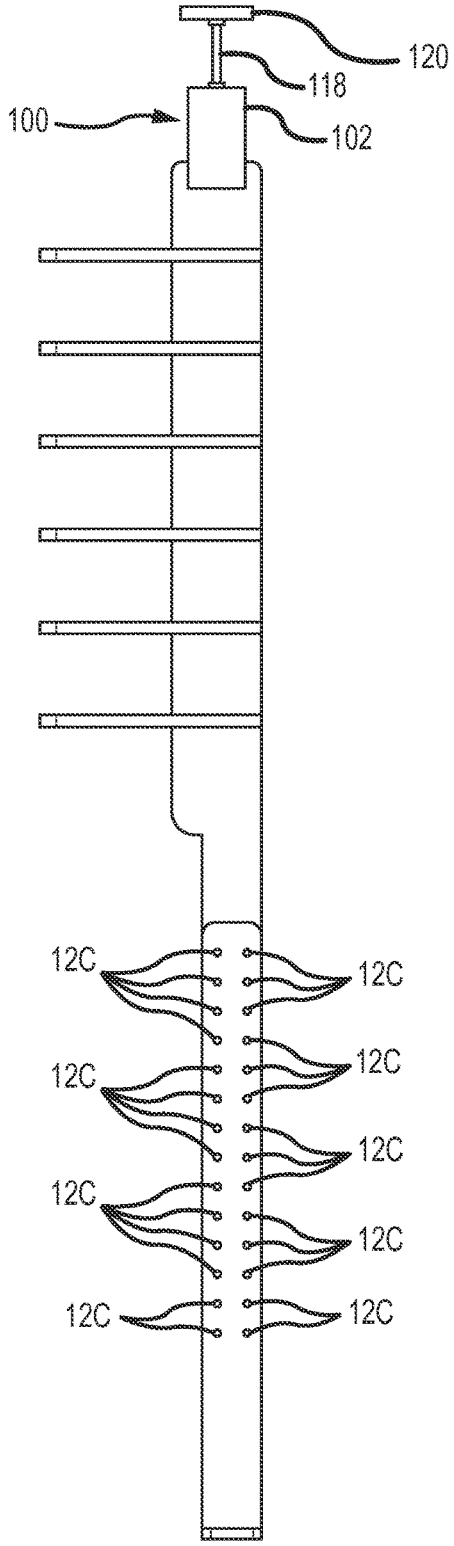
FIG. 5 is a side view of the embodiment shown in FIG. 2.
Figure 6:
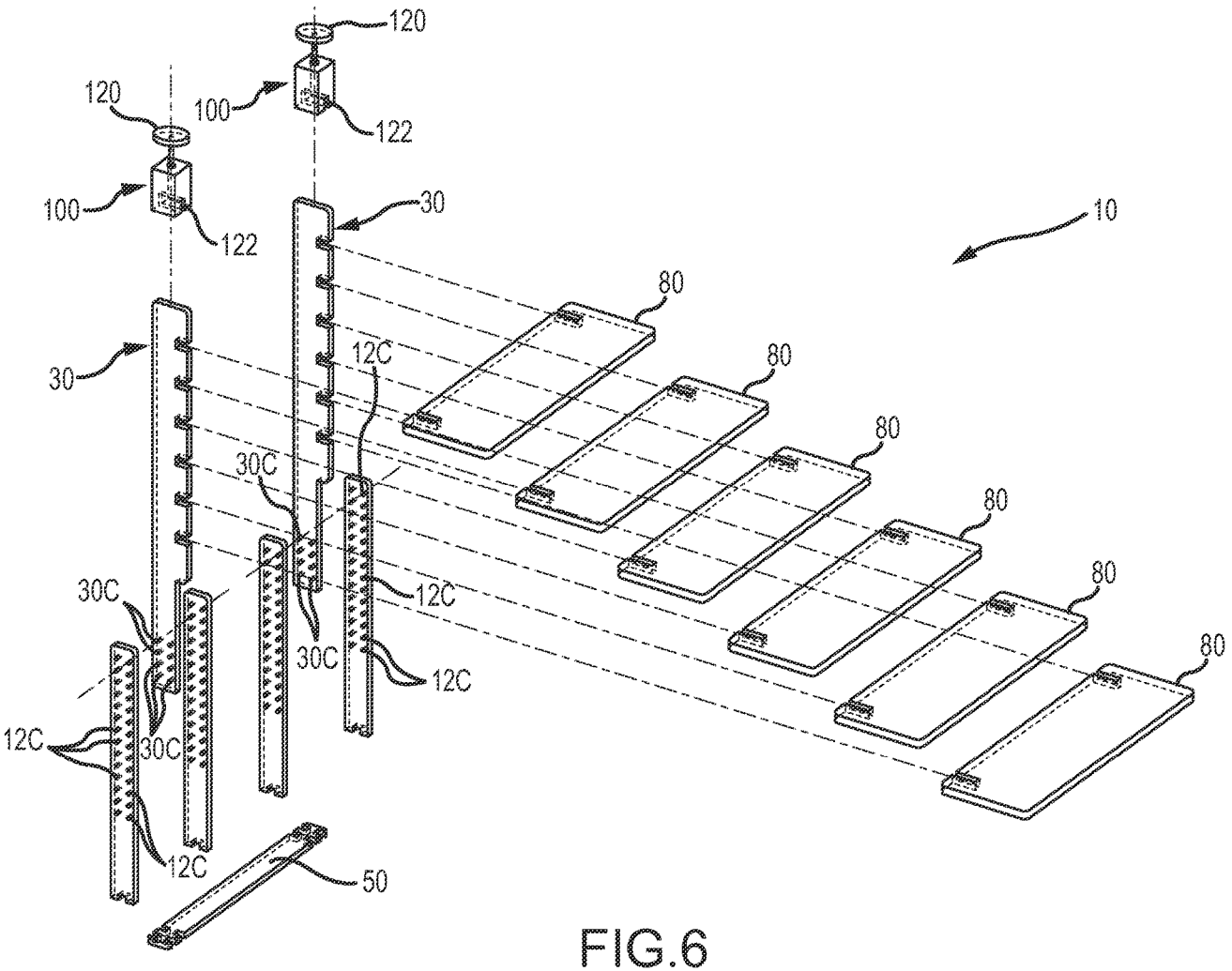
FIG. 6 is an exploded, partial cross-sectional view of the embodiment shown in FIG. 2.

Turning now to the drawings where the purpose is to describe preferred embodiments of the invention and not to limit same, FIGS. 1-6 shows modular shelving 10 in accordance with aspects of the present invention.

Modular shelving 10 includes one or more (and in this specific embodiment, two) first vertical support members 12, which as shown are formed by connecting submembers 12A and 12B, a second vertical support member 30, that fits between submembers 12A and 12B and is connected to a first vertical support member 12, and at least one horizontal support, which as shown is one or more shelves 80, although the horizontal support member could be a rod for holding clothes hangers or any other suitable horizontal support member. Preferably, modular shelving 10 also includes a base 50 and a top portion 100.

As shown, each first vertical support member 12 is comprised of submembers 12A and 12B. In this embodiment, a notch 14B is formed in the bottom of each submember 12A and 12B with legs 14A on either side of the notch.

Above the notch 14B is a plurality of first openings in submember 12A and a plurality of first openings 12C in submember 12B. The first openings 12C in each submember 12A and 12B are in vertical and horizontal alignment when the bottom of each submember is placed on an even surface, such as on base 50 when base 50 rests on an even surface. Each second vertical support member 30 has a lower portion 30A and an upper portion 30B. Lower portion 30A is configured to be received between first vertical submembers 12A and 12B and has a plurality of second openings 30C. Openings 30C are vertically spaced apart the same distance, and are preferably the same size, as openings 12C.

Upper portion 30B as shown is wider than lower portion 30A and includes slots 40 for receiving a horizontal support member. Slots 40 can be of any suitable shape and size for receiving a horizontal support member, depending upon the size and shape of the horizontal support member. In this embodiment there is a plurality of slots 40 in each second vertical support member 30. Each slot 40 in this embodiment is equally spaced vertically from the corresponding slot 40, and the space between sots 40 is the same for each second vertical member 30.

Further, in one aspect of this embodiment, the vertical distance between each slot 40 on each second vertical member 30 is the same as the distance between the respective openings 30C and respective openings 12C. With this structure, the slots 40 and hence the horizontal support members can be positioned far from a floor or object upon which the modular shelving 10 rests and furniture or other objects can fit underneath the horizontal supports. Some preferred positions for the lowest slots 40 are 3 feet, 4 feet, 5 feet and 6 feet above the bottom end of a first vertical support member 12.

Shelves 80 are one type of horizontal support member that may be used in the invention. Each shelf 80 is substantially flat and has grooves 80A that are received in slots 40 so that a groove 80A fits over the solid portion of section 30B behind a slot 40, and a slot 40 fits over the solid portion of a shelf 80 behind a groove 30A. As shown each shelf has the same width, but shelves of differing widths and/or configurations may be used. Also, different horizontal support members may be used at different vertical positions, such as a rod for holding clothes at one lower vertical position and one or more shelves above the rod.

Each second vertical member 30 includes a top 34. Preferably, an adjustment mechanism 100 fits on each top 34. Adjustment mechanism 100 has a base 110, a stem 118, a cap 120, and a slot 122. Slot 122 is configured so that a top 34 of a second support member 30 is received and pressure fit therein. Stem 118 is preferably threaded and is received in an opening on the top surface of adjustment mechanism 100. A screw boss may be included inside of adjustment mechanism 100 and be in communication with the opening. Cap 120 is attached to the top end of stem 118 in any suitable manner. In operation stem 118 can be threaded into or out of the opening and screw boss (if used) to adjust the vertical position of cap 120. In this manner cap 120 can be moved upward to pressure fit against an object such as a ceiling or other stationary object.

Base (or support base) 50 is preferably elongated and flat with paired base notches 52 to receive first submembers 12A and 12B. Base 50 can be of any suitable length and have any number of notches 52. The purpose of base 50 is to anchor submembers 12A and 12B and retain them at a proper distance from one another so that there is a space sufficient to fit a second vertical member 12C therebetween. With this configuration (regardless of whether base 50 is utilized) second vertical member(s) 30 can be adjusted vertically.

Figure 7:
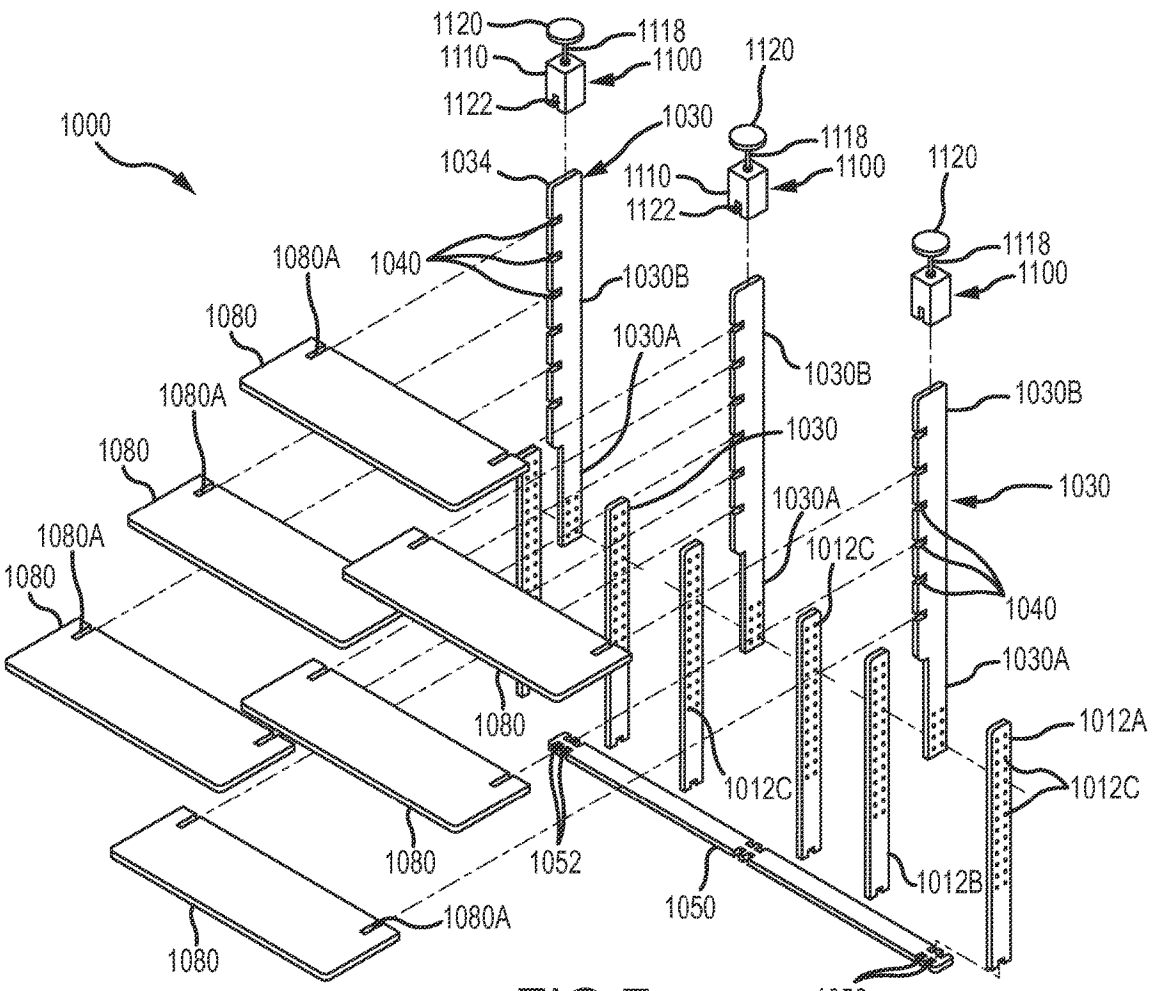
FIG. 7 is an exploded view of an alternate embodiment according to aspects of the invention.
Figure 8:
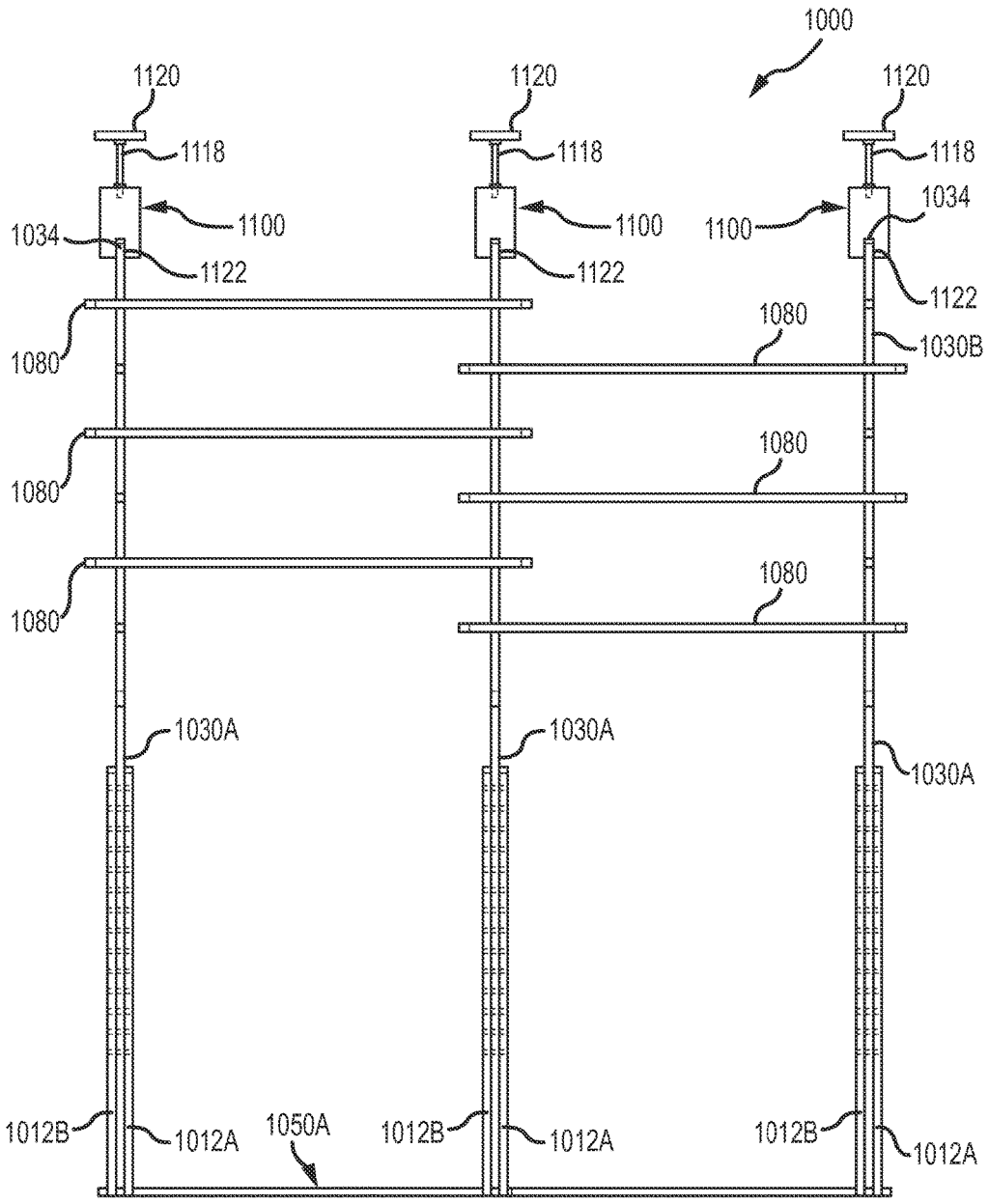
FIG. 8 is a front assembled view of the embodiment of FIG. 7.
Figure 9:
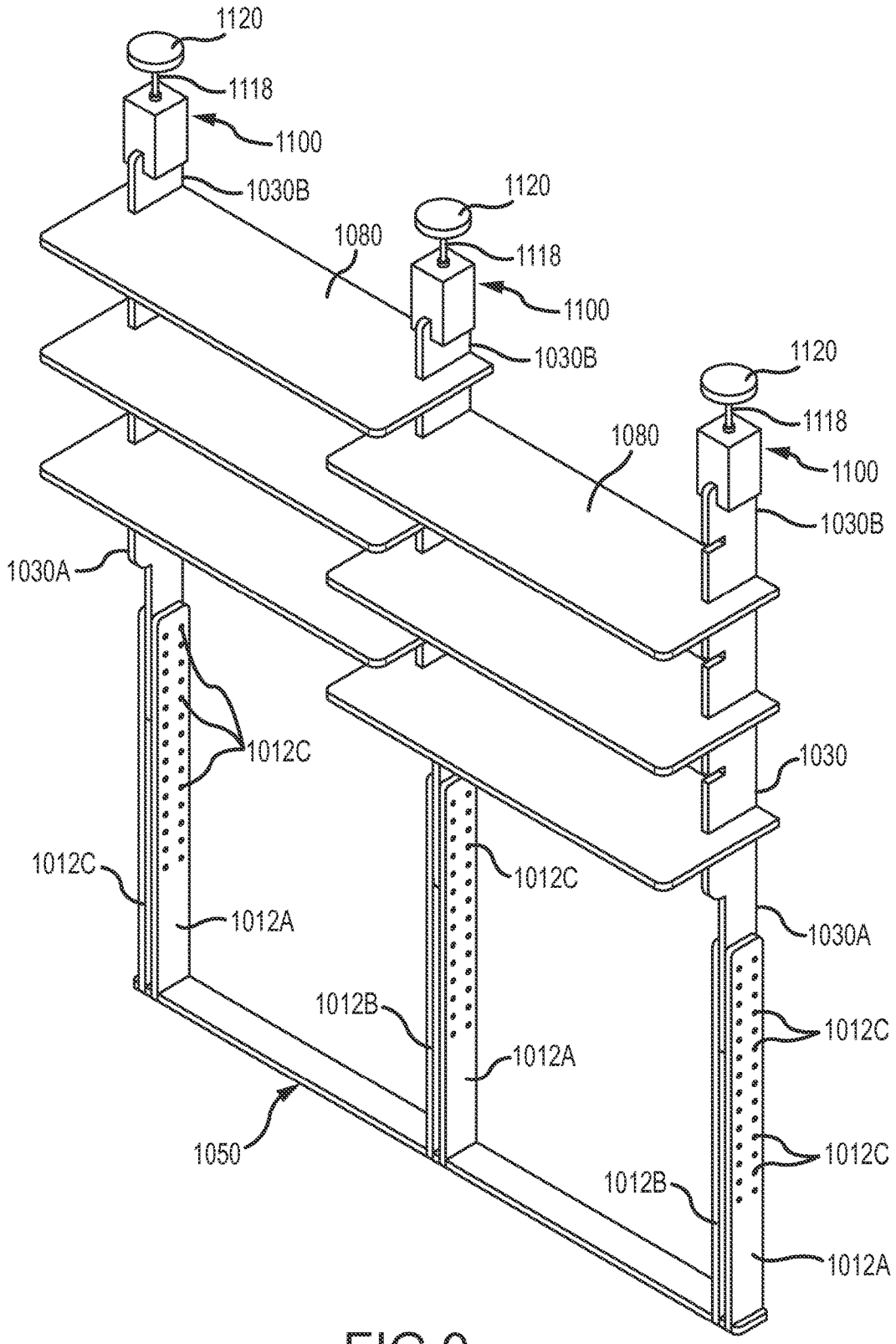
FIG. 9 is a front, perspective, cross-sectional view of the embodiment of FIG. 8.

An alternate embodiment 1000 of the invention is shown in FIGS. 7-9. Embodiment 1000 is in all respects the same as embodiment 10 except that it includes three second vertical members 1030, wherein each second vertical member 1030 is surrounded by submembers 1012A and 1012B in the same manner as submembers 12A and 12B surround and support second vertical member 30 as described above. This embodiment 1000 uses the same structures as embodiment 10, and identical structures are referenced by adding one thousand to the numeral designating a structure in embodiment 10. For example, structure 1030 in embodiment 12000 is the same as structure 30 in embodiment 10, and so forth. One exception is that base 1050 is longer than base 50.

Using the configuration of embodiment 1000 more support can be provided for horizontal members that stretch across all three second vertical members 1030 (this arrangement is not shown), or two sets of horizontal members 1080 may be used, as shown in FIGS. 7-9. The invention is thus not limited to any number of vertical or horizontal members or to any overall width or height. As shown in FIGS. 7-9, shelves 1080 are in a staggered configuration, although this is merely one embodiment.

Having thus described different embodiments of the invention, other variations and embodiments that do not depart from the spirit thereof will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired product or result.

What is claimed is:

1. Modular shelving comprising:

a plurality of first vertical members, each of the first vertical members including (i) a plurality of first openings extending along part of the length of each of the first plurality of vertical members, and (ii) a bottom having a notch and a leg on either side of the notch;

a plurality of second vertical members, each of which has (i) a plurality of second openings extending along the length of each of the second plurality of vertical members, and (ii) a plurality of slots above the plurality of second openings; and a plurality of horizontal supports each fitting in at least two slots and being configured to support one or more of a shelf and a rod; and a flat base having a plurality of paired base notches, wherein each of the plurality of paired base notches receives the legs on the bottom of one of the plurality of the first vertical members; and wherein there are at least two spaced-apart second vertical members, each of the second vertical members having an inner side and an outer side, there is a first vertical member positioned on each inner side, and another first vertical member positioned on each outer side, there being a distance between the first vertical members positioned on the outer side of each of the spaced-apart second vertical members, and the base has a length greater than the distance.

2. The modular shelving of claim 1 wherein the base is horizontally-oriented.

3. The modular shelving of claim 1 wherein each second vertical member is positioned at the same height.

4. The modular shelving of claim 1 that further includes an adjustment mechanism on the top of each of the plurality of second vertical members, wherein each adjustment mechanism can be moved vertically in order to press against an object above the adjustment mechanism.

5. The modular shelving of claim 1 that further includes one or more of a shelf and a rod.

6. The modular shelving of claim 4 wherein the adjustment mechanism comprises a bottom section having a slot that is received on the top of one of the plurality of second vertical members.

7. The modular shelving of claim 6 wherein the adjustment mechanism further includes an end cap attached to a threaded stem, the threaded stem being received in an opening in the bottom section and operable to be threaded upwards or downwards.

8. The modular shelving of claim 7 wherein there is a screw boss below the opening and the threaded stem is also received in the screw boss.

9. The modular shelving of claim 1 wherein the first plurality of openings comprises openings equally spaced vertically along the first vertical member.

10. The modular shelving of claim 9 wherein the second plurality of openings comprises openings equally spaced vertically along the second vertical member.

11. The modular shelving of claim 10 wherein the space between each of the first plurality of openings is equal and the space between each of the second plurality of openings is equal.

12. The modular shelving of claim 1 wherein the slots are equally spaced vertically along the second vertical member.

13. The modular shelving of claim 1 wherein the slots are equally spaced vertically along the second vertical member, each of the second plurality of openings is equally spaced vertically along the second vertical member and the space between each of the second plurality of openings equals the space between each of the slots.

* * * * *